US005215456A

United States Patent [19]

Fujiwara

[11] Patent Number: 5,215,456

[45] Date of Patent: Jun. 1, 1993

[54] GAS COMBUSTION METHOD AND APPARATUS

[75] Inventor: Akinobu Fujiwara, Yamanashi, Japan

[73] Assignee: Nakajima Copper Works, Inc., Saitama, Japan

[21] Appl. No.: 901,842

[22] Filed: Jun. 22, 1992

[30] Foreign Application Priority Data

Jun. 29, 1991 [JP] Japan ..... 3-182861

[51] Int. Cl.[5] ..... B23K 3/02

[52] U.S. Cl. ..... 431/7; 431/75; 431/328; 126/414; 126/406; 126/407

[58] Field of Search ..... 431/328, 75, 6, 7; 126/403, 404, 406, 407, 408, 409, 413, 414

[56] References Cited

U.S. PATENT DOCUMENTS 4,119,088 10/1978 Sim .
4,133,301 1/1979 Fujiwara .
4,552,124 11/1985 Nakajima .
4,565,521 1/1986 Hancock ..... 431/75
4,688,551 8/1987 Nakajima .
4,920,952 5/1990 Nakajima ..... 126/414

*Primary Examiner*—Carroll B. Dority
*Attorney, Agent, or Firm*—Longacre & White

[57] ABSTRACT

A gas combustion method and apparatus for performing such comprises supplying a fuel gas, generating a gas mixture composed of the fuel gas and external air, diffusing the gas mixture through a diffusion member to lower a flow velocity of thereof, putting the gas mixture to flaming combustion in a cylindrical combustion chamber thereby elevating the temperature of a combustion catalyst disposed to the downstream end of the combustion chamber by the heat of the flaming combustion, then ceasing the diffusion of the gas mixture to increase the flow velocity thereof in the combustion chamber, thereby extinguishing the combustion flame and directly supplying the gas mixture to the combustion catalyst. The gas mixture is put into and out of diffusion by an actuating mechanism that brings a diffusion member into and away from the entrance of the combustion chamber.

4 Claims, 4 Drawing Sheets

GAS COMBUSTION METHOD AND APPARATUS

BACKGROUND OF THE INVENTION

1. Field of the Invention

The present invention concerns a gas combustion method for catalytic flameless combustion of a gas mixture comprising air and a liquefied gas such as a butane gas by using a combustion catalyst, as well as an apparatus used therefor and, more in particular, it relates to an improvement to the system for transferring a combustion mode from flaming combustion upon ignition to. aimed catalytic flameless combustion.

2. Description of the Prior Art

Gas combustion apparatus using a liquefied gas as a fuel gas is generally classified into a well-known torch lamp type apparatus that directly utilizes heat obtained by flaming combustion and a so-called catalytic combustion apparatus for flameless combustion of an air/fuel gas mixture by using a combustion catalyst as described, for example, by A. Fujiwara in U.S. Pat. No. 4,133,301.

By the way, when a massive and solid catalyst is used as a combustion catalyst in the catalytic gas combustion apparatus, it is necessary that the combustion catalyst is at first heated to an oxidizing reaction temperature by a pilot flame of flaming combustion and that the pilot flame is extinguished subsequently and the gas mixture is directly supplied to the heated combustion catalyst.

For extinguishing the pilot flame, U.S. Pat. No. 4,552,124 discloses a structure in which an opening disposed to a combustion chamber is closed by a shutter mechanism and U.S. Pat. No. 4,688,551 proposes a structure in which an air intake port of a gas mixture generation member is once closed wholly by a air flow rate control member after igniting a pilot flame.

In the existent pilot flame extinguishing means described above, the former method of using the shutter mechanism requires a movable shutter member to the combustion chamber. In addition, since the opening is kept open during flaming combustion, it may possibly lead to flashing danger in a case where flammable material is present near at hand.

On the contrary, since the latter method uses the operation member for extinguishing the flame by the change of the air/fuel gas mixing ratio, it can save the opening and the shutter to be disposed to the combustion chamber if the size of the combustion chamber is large enough. Accordingly, there is no risk of catching fire even if flammable material is present near at hand. However, when the air intake port of the operation member is wholly closed upon extinction of the pilot flame, since a fuel gas not containing air at all is not burnt by the combustion catalyst but discharged as it is to the outside. This may cause a danger that the fuel gas flames up at the outside of the apparatus through it is only momentary.

OBJECT OF THE INVENTION

The present invention has been accomplished in view of the foregoing situations and it is an object of the invention to provide a gas combustion method and apparatus capable of simply and reliably extinguishing a pilot flame of flaming combustion, free from flashing danger even if flammable material is present near at hand and with no worry of causing flaming combustion at the outside of the apparatus.

Another object of the invention is provide a gas combustion apparatus capable of automatically extinguishing a pilot flame of flaming combustion.

A further object of the present invention is to provide a gas combustion apparatus that can be assembled easily into a heat processing apparatus or the like.

SUMMARY OF THE INVENTION

The foregoing object of the present invention can be attained by a gas combustion method which comprises the steps of:

supplying a fuel gas from a gas reservoir, generating a gas mixture composed of the fuel gas and external air, diffusing the gas mixture through a diffusion member to lower a flow velocity of the gas mixture, putting the gas mixture to flaming combustion in a cylindrical combustion chamber thereby elevating the temperature of a combustion catalyst disposed to the downstream end of the combustion chamber by the heat of a pilot flame of the flaming combustion, and then ceasing the diffusion of the gas mixture to increase the flow velocity of the gas mixture in the combustion chamber thereby extinguishing the pilot flame and supplying the gas mixture directly to the combustion catalyst for taking place catalytic flameless combustion.

The combustion method according to the present invention described above can be practiced by a gas combustion apparatus comprising:

a fuel gas reservoir for jetting out a liquefied fuel gas, a gas mixture generation member for generating a gas mixture composed of the fuel gas and external air;

a cylindrical combustion chamber for taking plate flaming combustion the gas mixture, a combustion catalyst disposed to the downstream end of the combustion chamber and heated by flaming combustion in the combustion chamber, a diffusion member disposed retractably to a gas stream for diffusing the gas mixture in said cylindrical combustion chamber to lower the flow velocity thereof, an actuating mechanism for retracting the diffusion member from the gas stream thereby ceasing the diffusion of the gas mixture and increasing the flow velocity of the gas mixture in the combustion chamber to extinguish the pilot flame.

In the present invention, since the actuating mechanism is operated to cease the diffusion of the gas mixture, the flow velocity of the gas mixture in the cylindrical combustion chamber is increased thereby enabling to extinguish the pilot flame of the flaming combustion easily and reliably.

DESCRIPTION OF THE ACCOMPANYING DRAWINGS

These and other objects, as well as advantageous features of the present invention will become apparent by reading the following description for the preferred embodiments in conjunction with the appended drawings, wherein FIG. 1 is a constitutional view for a portion of a gas combustion apparatus as a preferred embodiment according to the present invention for illustrating a state in which a combustion flame is extinguished;

DESCRIPTION OF THE PREFERRED EMBODIMENTS

Description will be made at first with reference to FIGS. 1 and 2.

Figure 1:
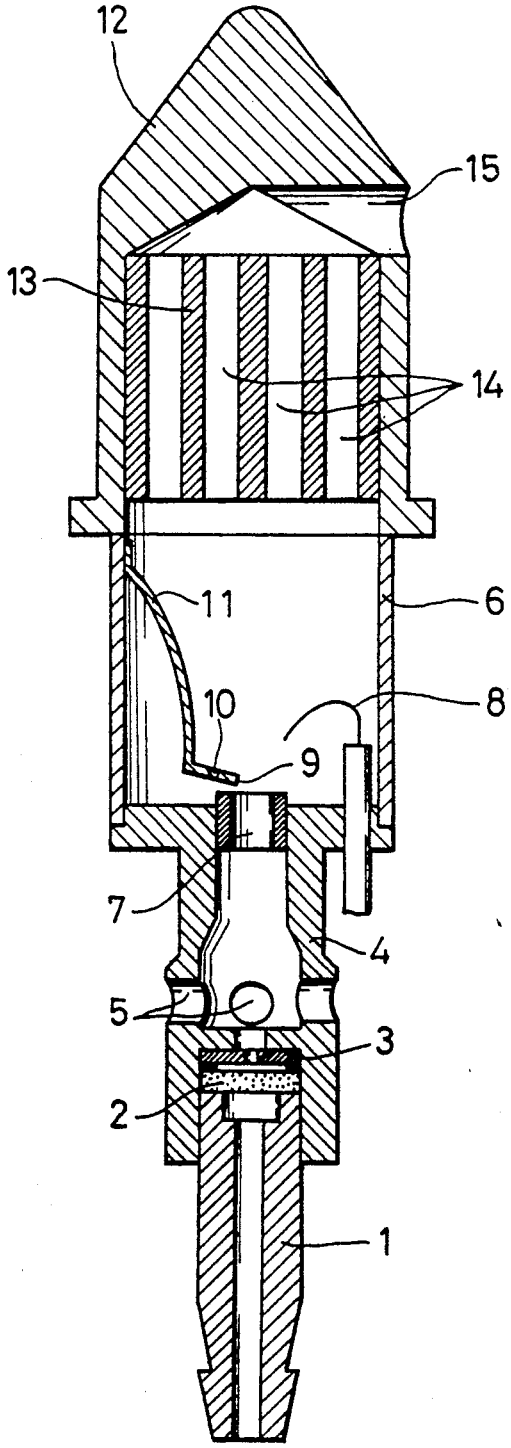
Figure 2:
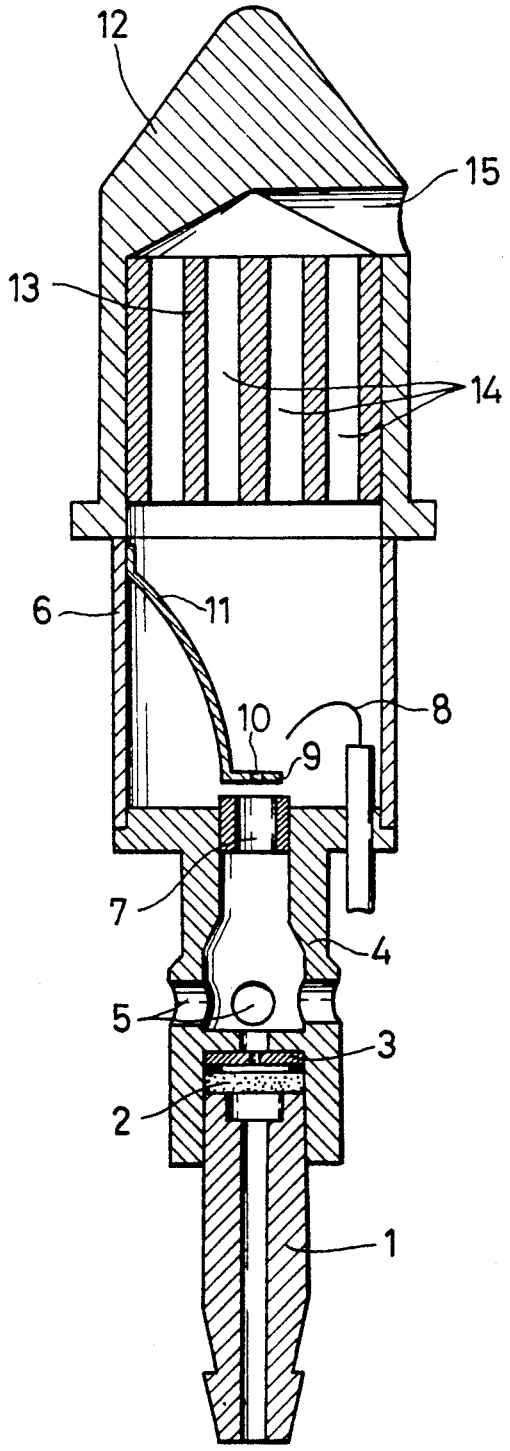
FIG. 2 is a constitutional view for a portion of the apparatus shown in FIG. 1 for illustrating a state in which flaming combustion is taken plane.

FIGS. 1 and 2 illustrate a case in which a gas combustion apparatus according to the present invention is applied to a gas soldering iron. In the drawings, reference numeral 1 denotes a gas supply pipe through which a liquefied gas such as a butane gas supplied from a liquefied gas reservoir (not illustrated) is introduced as a fuel gas. The fuel gas sent by way of the gas supply pipe 1 is passed through a filter 2 and an orifice 3 and then jetted out into a cylindrical gas mixture generation member 4.

As shown in FIGS. 1 and 2, a plurality of air intake ports 5 are disposed along the circumferential surface of the gas mixture generation member 4, so that external air is sucked by way of the air intake ports 5 into the gas mixture generation member 4 under an ejector effect caused by the jetting of the fuel gas from the orifice 3, to form a gas mixture comprising the fuel gas and air. Then, the gas mixture is jetted out from a jetting port 7 into a cylindrical combustion chamber 6 which is disposed in contiguous with the downstream end of the gas mixture generation member 4. A diffusion plate comprising a metal net (not illustrated) may be disposed to the jetting port 7 for controlling the flow velocity of the gas mixture.

In the combustion chamber 6, as shown in FIGS. 1 and 2, are disposed a piezoelectric ignition plug 8 as an automatic ignition mechanism for the gas mixture and a diffusion member 9 for diffusing the gas mixture and lowering the flow velocity thereof, respectively.

Figure 3:
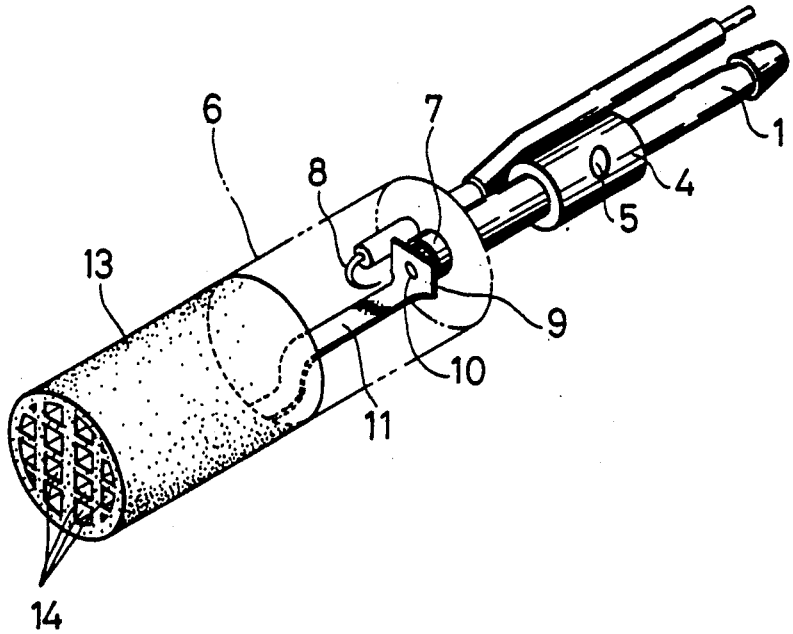
FIG. 3 is a perspective view for a portion shown in FIG. 2.

As shown in FIG. 1 through FIG. 3, the diffusion member 9 is formed, for example, as a square plate and situates just downstream of the jetting port 7, so that the gas mixture jetted out from the jetting port 7 collides against the surface of the diffusion member 9 and is diffused to lower the flow velocity. Then, the gas mixture at a low flow velocity is ignited by electric discharge sparks generated by the piezoelectric ignition plug 8 and put to flaming combustion in the combustion chamber 6.

As shown in FIG. 1 through FIG. 3, a small aperture 10 is optionally formed at the central portion of the diffusion member 9 for facilitating the ignition by the piezoelectric ignition plug 8.

The diffusion member 9 is secured by way of an actuating mechanism illustrated in this embodiment as a heat responsive member 11 made of bimetals in the combustion chamber 6.

The heat responsive member 11 (bimetals) is so designed that it thermally actuates to conduct configurational transformation in response to the heat sensed in the combustion chamber 6, to thereby make the diffusion member 9 displace between a position interfering the stream of the gas mixture at the entrance of the chamber 6 shown in FIGS. 2 and 3 and a position retracted from the interfering position as shown in FIG. 1. In the state shown in FIG. 1, diffusion of the gas mixture by the diffusion member 11 is ceased and the flow velocity of the gas mixture in the combustion chamber 6 is increased to blow out the pilot flame.

Also as shown in FIGS. 1 and 2, an iron tip 12 of a gas soldering iron is disposed in contiguous with the top end of the combustion chamber 6 as shown in FIGS. 1 and 2. A combustion catalyst 13 for flameless combustion of the gas mixture is inserted into and secured to the soldering iron tip 12.

As shown in FIG. 1 through FIG. 3, the combustion catalyst comprises a cylindrical catalyst support mainly composed of alumina in which a plurality of axial channels 14 are formed. $\gamma$-alumina coating layer is applied on the outer circumferential surface and inner channel walls of the catalyst support and a catalyst ingredient comprising platinum and rhodium is carried on the outer surface of the alumina coating layer. The combustion catalyst 13 is heated to a temperature for oxidizing reaction in about 1 to 2 seconds. after ignition by the heat of the pilot flame. Then, catalytic flameless combustion is subsequently conducted by the supply of the gas mixture after extinction of the pilot flame, and combustion exhausts are discharged to the outside as shown in FIGS. 1 and 2, from an exhaust port 15 disposed at the iron tip 12.

Figure 4:
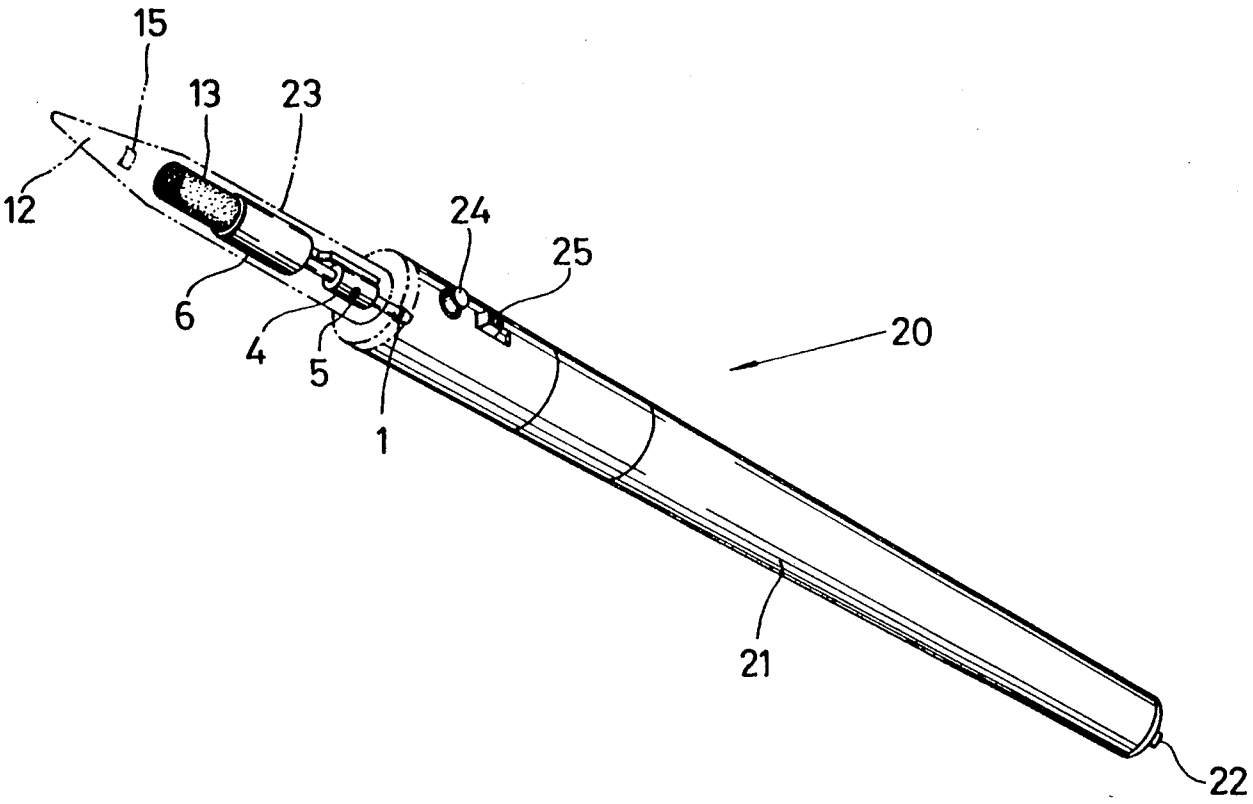
FIG. 4 is a perspective view illustrating an example of a soldering iron to which the gas combustion apparatus shown in FIG. 3 is incorporated.

FIG. 4 illustrates a practical embodiment of a gas soldering iron incorporated with the gas combustion apparatus of this invention, in which a gas soldering iron 20 has a grip 21 that is used also as a liquefied gas reservoir, and a gas injection valve 22 is disposed to the rear end thereof.

As shown in FIG. 4, a support pipe 23 incorporating the gas mixture generation member 4 and a combustion chamber 6 is provided at the downstream end of the grip 21, and an iron tip 12 incorporating a combustion catalyst 13 is detachably mounted to the downstream end of the support pipe 23. An ignition button 24 and a gas ON-OFF valve switch 25 for the control of the gas combustion apparatus are attached to the outer circumference at the downstream end of the grip 21.

Description will now be made to the gas combustion method according to this embodiment.

When a liquefied gas is introduced as a fuel gas to the gas supply pipe 1, the fuel gas is jetted out through the filter 2 and the orifice 3 into the gas mixture generation member 4. Then, the air is sucked from the intake ports 5 under an ejector effect of the fuel gas jetting into the gas mixture generation member 4 and a gas mixture composed of the fuel gas and air are generated in the gas mixture generation member 4.

The gas mixture is sent from the jetting port 7 into the combustion chamber 6. As shown in FIG. 2, since the diffusion member 9 situates just downstream of the jetting port 7, the gas mixture collides against the diffusion plate 9 and is diffused to lower the flow velocity.

When electric discharge sparks are generated by the piezoelectric ignition plug 8 in this state, the gas mixture is ignited by the sparks to take place flaming combustion in the combustion chamber 6. Then, the combustion catalyst 13 is heated by the heat of the pilot flame and reaches an oxidizing reaction temperature in about 1 to 2 seconds after the ignition.

On the other hand, about 2 seconds after the ignition, the heat responsive member 11 senses the heat of the flaming combustion in the combustion chamber 6 and deforms quickly by bimetal action, to thereby displace the diffusion member 9 from a position interfering the stream of the gas mixture shown in FIG. 2 to a position retracted from the interfering position shown in FIG. 1. Then, the gas mixture is no more diffused by the diffusion member 9 and the gas mixture from the jetting port 7 is supplied as it is with no diffusion into the combustion chamber 6. Accordingly, the flow velocity of the gas mixture in the combustion chamber 6 is increased. As the flow velocity of the gas mixture is increased, the pilot flame of the flaming combustion is blown out, and the gas mixture is supplied directly with no combustion into the combustion catalyst 13. Then, flameless combustion is started by the combustion catalyst 13.

After the flame has been extinguished, more specifically, upon elapse of about 2 seconds after starting the catalytic flameless combustion, the heat responsive member 11 senses the lowering of the temperature in the combustion chamber 6 caused by flame extinction, and the heat responsive member 11 returns to its original configuration. Then, as shown in FIG. 2, the diffusion member 9 is displaced to the position that interferes the stream of the gas mixture to start the diffusion of the gas mixture again by the diffusion member 9. However, once after the flame has been extinguished, flaming combustion does not take place again in the combustion chamber 6 even if the gas mixture is diffused by the diffusion member 9 and the flow velocity thereof is lowered. That is, only the catalytic flameless combustion by the combustion catalyst 13 is continued. This is probably attributable to the fact that a temperature required for igniting the gas mixture is higher than the temperature for the catalytic flameless combustion of the combustion catalyst 13.

In this way, the flaming combustion can be transferred to the flameless combustion by merely displacing the diffusion member 9, in which the pilot flame is extinguished by changing the flow velocity of the gas mixture in the combustion chamber 6. Accordingly, there is no requirement for disposing the opening to the combustion chamber or changing the mixing ratio of the gas mixture as in the prior art, which required complicated structures.

Further, since the diffusion member 9 is automatically displaced by the heat responsive member 11 that thermally actuates upon sensing the heat of combustion in the combustion chamber 6, it is free from the disadvantage that the flame is extinguished before the temperature of the combustion catalyst 13 reaches the oxidizing reaction temperature or, on the contrary, that the flame is extinguished too late, thereby damaging the combustion catalyst 13 by the heat of the flaming combustion.

In addition, since the diffusion member 9 and the heat responsive member 11 are accommodated together with the piezoelectric ignition plug 8 in the combustion chamber 6, they can be assembled easily even in a small-sized instrument such as a gas soldering iron. Particularly, when the diffusion member and the heat responsive member 11 are so designed that they are exchanged together with the combustion chamber 6 when they are degraded by use, labor for the exchanging operation is moderated.

In thè embodiment described above, description has been made to such a case in which the diffusion member 9 and the heat responsive member 11 constitute an integral structure but a diffusion member 9 may be disposed separately and slidably driven by a heat responsive member 11.

Although description has been made to a case of making the heat responsive member 11 by bimetals but the member 11 may be made of a shape memory alloy. In this case, a bias spring may be used in combination for emphasizing the reversibility of the member.

Although description has been made to a case in which the diffusion of the gas mixture by the diffusion member 9 is ceased automatically by the heat responsive member 11, the diffusion member 9 may be operated manually.

Further, description has been made to a case in which the diffusion member 9 is displaced sideway from the position that interferes the stream of the gas mixture to the position out of the interfering position, thereby ceasing the diffusion. However, the diffusion may be ceased also by making the diffusion member rotatable at a position just downstream of the injection port 7 by 90° around a horizontal axis (in FIGS. 1 and 2) thereby directing the surface of the diffusion member 9 in parallel with the stream of the gas mixture.

Further, description has been made to a case in which the diffusion member 9 and the heat responsive member 11 are disposed in the combustion chamber 6. However, it is not necessary to dispose them in the combustion chamber 6, so long as the gas mixture can be diffused and the heat of flaming combustion can be sensed.

Further, although description has been made to a case in which the present invention is applied to the gas soldering iron, it may be applied generally also to other gas combustion methods and apparatus for conducting catalytic flameless combustion such as a heat processing apparatus utilizing the combustion exhaust as a hot blow, a hot melt gun or a water warmer.

The present inventor et al experimentally manufactured a gas combustion apparatus by using bimetals of 1 mm thickness, 4 mm width and 20 mm length as the heat responsive member 11 and incorporating them into a gas soldering iron and conducted a gas combustion experiment.

As a result, it was confirmed that the heat responsive member 11 turned from the state shown in FIG. 2 to that shown in FIG. 1 about 2 seconds after igniting the gas mixture, diffusion of the gas mixture by the diffusion member 9 was ceased, a pilot flame of the flaming combustion was blown out and the combustion mode transferred to the flameless combustion.

It was also confirmed that the heat responsive member 11 returned to the original state shown in FIG. 2 about 2 seconds after transfer to the flameless combustion, that is, after fire extinction. This indicates that the diffusion of the gas mixture by the diffusion member 9 started again.

By the way, iron and copper alloys are usually used for the bimetals but the temperature of the bimetals may sometimes exceeds 300° C. upon combustion. Therefore, there is a worry that the bimetals are injured in a relatively short period of time due to oxidation or heat of irradiation from the combustion catalyst 13.

Then, it is preferred to apply gold or nickel plating or coating of ceramics such as alumina or silica on the surface of the bimetals to improve the heat resistance. According to the experiment conducted by the present inventor, et al under the same conditions as above using bimetals with improved heat resistance, it was confirmed that the temperature of the bimetals usually exceeding 300° C. could be lowered to about 150°-200° C. In particular, when a nickel plating of 20 to 25 um thickness was applied and a glossy gold plating of 1 to 2 um thickness was applied further thereover, the temperature of the bimetals could be restricted to lower than 150° C.

Further, the present inventor et al used a Ni-Ti shape memory alloy of 1 mm thickness, 4 mm width and 20 mm length as the heat responsive member 11 on which a spring steel of 0.5 mm thickness, 4 mm width and 20 mm length was stacked as a bias spring, and they were welded at the ends on one side. Then, the present inventor, et al have conducted the same experiment as that for the bimetals.

As a result, substantially the same effect as that of the bimetals could be obtained and it was confirmed that the heat responsive member could be put to a practical use in the same manner as the bimetals.

As has been described above, in the gas combustion method according to the present invention, the combustion catalyst disposed at the downstream end of the combustion chamber is heated to a temperature for oxidizing reaction by the heat of flaming combustion in the combustion chamber and then the diffusion of the gas mixture by the diffusion member is ceased. Therefore, the flow velocity of the gas mixture in the combustion chamber is increased to blow out the pilot flame of the flaming combustion in the combustion chamber and the mode of combustion can be transferred smoothly to catalytic flameless combustion. Further, for extinguishing the pilot flame, only the flow velocity of the gas mixture is changed but the mixing ratio thereof is not varied. Accordingly, there is no worry at all that the fuel gas flames up at the outside of the apparatus.

Further, in the gas combustion apparatus according to the present invention, the gas mixture generated by the gas mixture generation member is diffused through the diffusion member to lower the gas flow velocity, the diffused gas is put to flaming combustion in the combustion chamber to heat the combustion catalyst to an oxidizing reaction temperature and then the diffusion member is driven away by the actuation mechanism to cease the diffusion of the gas mixture. Therefore, flaming combustion can be transferred smoothly into catalytic flameless combustion. In this case, if the volume of the combustion chamber is made sufficiently large, since the inside of the combustion chamber can be made as a substantially closed space, there is no worry of flashing danger even when a flammable material is present near at hand. In addition, since the mixing ratio of the gas mixture is not changed, upon fire extinction, there is no worry that the fuel gas flames up at the outside of the apparatus.

According to the present invention, since the actuating mechanism is constituted with a heat responsive member that drives away the diffusion member automatically upon sensing the heat of flaming combustion in the combustion chamber, a pilot flame can be extinguished automatically and reliably.

Further, since the diffusion member and the actuating mechanism are disposed in the combustion chamber, they can be assembled easily into a heat processing apparatus or the like and can be exchanged easily when they are degraded after long time use.

As many apparently widely different embodiments of this invention may be made without departing from the spirit and scope thereof, it is to be understood that the invention is not limited to the specific embodiments thereof defined in the appended claims.

What is claimed is:

1. A gas combustion method which comprises the steps of;

supplying a fuel gas from a gas reservoir, generating a gas mixture composed of the fuel gas and external air, diffusing the gas mixture through a diffusion member to lower a flow velocity of the gas mixture, putting the gas mixture to flaming combustion in a cylindrical combustion chamber thereby elevating the temperature of a combustion catalyst disposed to the downstream end of said combustion chamber by the heat of a pilot flame of the flaming combustion, and then ceasing the diffusion of the gas mixture to increase the flow velocity of the gas mixture in said combustion chamber thereby extinguishing the pilot flame and supplying the gas mixture directly to said combustion catalyst for taking place catalystic flameless combustion.

2. A gas combustion apparatus comprising:

a fuel gas reservoir for jetting out a liquefied fuel gas, a gas mixture generation member for generating a gas mixture composed of the fuel gas and external air;

a cylindrical combustion chamber for taking place flaming combustion the gas mixture;

a combustion catalyst disposed to the downstream end of said combustion chamber and heated by flaming combustion in said combustion chamber;

a diffusion member disposed retractably to a gas stream for diffusing the gas mixture in said cylindrical combustion chamber to lower the flow velocity thereof;

an actuating mechanism for retracting said diffusion member from said gas stream thereby ceasing the diffusion of the gas mixture and increasing the flow velocity of the gas mixture in said combustion chamber to extinguish the pilot flame.

3. A gas combustion apparatus as defined in claim 2, wherein the actuating mechanism comprises a heat responsive member that automatically drives the diffusion member upon sensing the heat of flaming combustion in the combustion chamber.

4. A gas combustion apparatus as defined in claim 2, wherein the diffusion member and the actuating mechanism are disposed in the combustion chamber.

* * * * *